US005586622A

United States Patent [19]

Hu

[11] Patent Number: 5,586,622

[45] Date of Patent: Dec. 24, 1996

[54] BRAKE OF A BABY'S WALKER

[76] Inventor: Stephen Hu, No. 2, Ta Ton Road, Hsinchu Industrial Area, Hu Kou, Hsinchu, Taiwan

[21] Appl. No.: 396,955

[22] Filed: Mar. 1, 1995

[51] Int. Cl.[6] ..... B62B 9/08

[52] U.S. Cl. ..... 188/20; 188/5; 280/87.051; 280/43.14

[58] Field of Search ..... 188/5, 20, 32; 280/87.051, 43.14, 43.18, 87.05, 33.994

[56] References Cited

U.S. PATENT DOCUMENTS

| | | | |
|---|---|---|---|
| 2,480,431 | 8/1949 | Welsh | 188/20 |
| 3,715,015 | 2/1973 | Morris | 188/5 |
| 5,080,383 | 1/1992 | Hsieh | 188/5 X |
| 5,366,231 | 11/1994 | Hung | 280/87.051 |
| 5,462,300 | 10/1995 | Chien | 280/87.051 |

*Primary Examiner*—Robert J. Oberleitner
*Assistant Examiner*—Peter M. Poon
*Attorney, Agent, or Firm*—Beveridge, DeGrandi, Weilacher & Young, L.L.P.

[57] ABSTRACT

This invention is a brake for a baby's walker. The brake's friction with the floor is increased by a slide-resisting piece attached to the braking support. It prevents the walker from sliding when the brake is against the ground. The supporting pole of the brake is extended in and out by a spring and slide mechanism. The spring and slide mechanism is located within a revolving casing. A horizontal piece on the slide is adapted to smoothly traverse the inner periphery of the casing along a helical guide. The guide forces the slide, and the brake attached to it, to move up and down as a revolving switch is turned. The guide also has a locking portion to hold the slide, and the brake, in extended position.

7 Claims, 10 Drawing Sheets

BRAKE OF A BABY'S WALKER

BACKGROUND OF THE INVENTION

In the midst of an ever increasing standard of living, the issue of kids' safety is being considered more and more. To provide a safer environment for children, every kind of facility designed for kids is being improved and upgraded continuously.

The traditional baby's walker design, which enables a child to make the walker slide freely, is no exception. Even a slight moment of an adults' inattentiveness can result in an accident. Further, if the walker cannot be securely prevented from movement, it becomes quite inconvenient to place or remove a baby from within the walker. This has resulted in several upgraded designs. For example, conventional walkers have added the drawable canvas or the brake, as seen in FIGS. 8 and 7, respectively.

However, even though these upgraded walkers improve the overall safety of the walker, they are still not safe enough and are inconvenient, as free movement is still permitted.

THE SUMMARY OF THE INVENTION

The main purpose of this invention is to provide a brake for a baby's walker. The brake's friction with the floor is increased by a slide-resisting piece attached to the braking support. It prevents the walker from sliding when the brake is against the ground. The supporting pole of the brake is extended in and out by a spring and slide mechanism. The spring and slide mechanism is located within a revolving casing. A horizontal piece on the slide is adapted to smoothly traverse the inner periphery of the casing along a helical guide. The guide forces the slide, and the brake attached to it, to move up and down as a revolving switch is turned. The guide also has a locking portion to hold the slide, and the brake, in extended position.

Thus, in order to fully understand more about the structure, characteristics, purpose and function of this invention, a detailed and clear explanation follows, with reference to the following figures:

DETAILED DESCRIPTION OF THIS INVENTION

Figure 1:
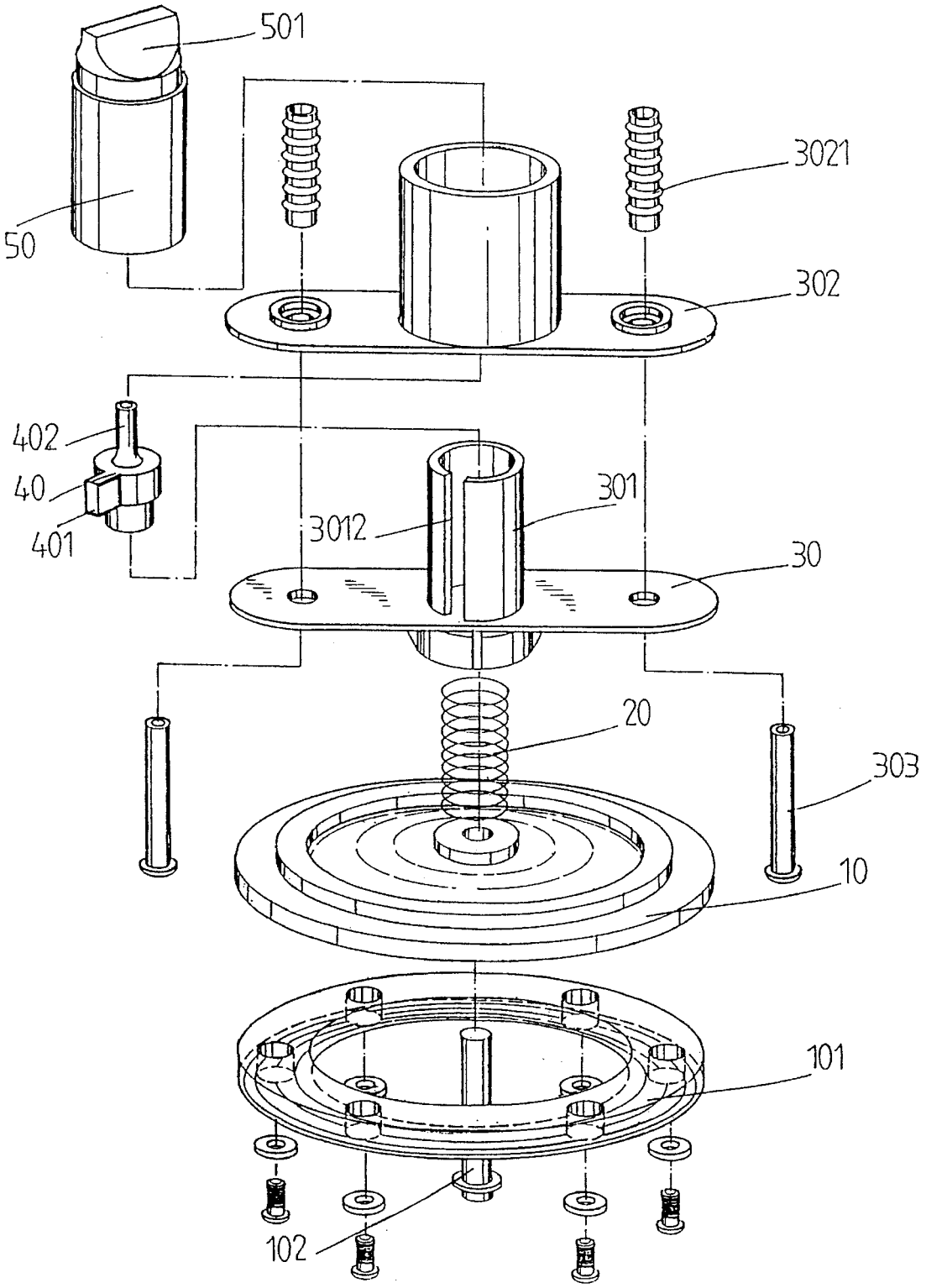
FIG. 1 is the exploded view of this invention.
Figure 2:
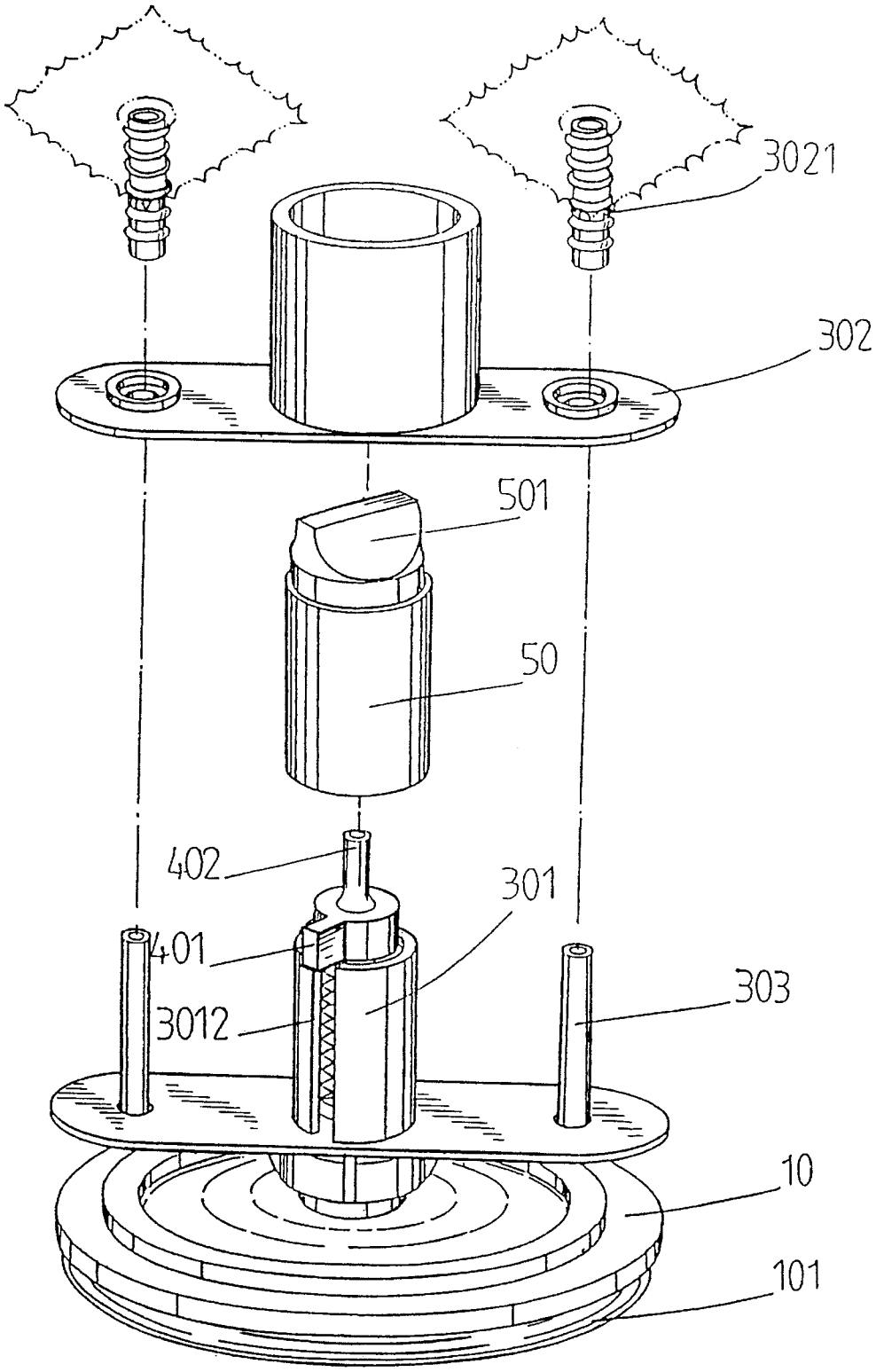
FIG. 2 is the fragmentary view of this invention.

Please refer to the exploded view of this invention illustrated in FIG. 1 and to FIG. 2. The bottom of support 10 is joined to a slide-resisting piece 101, having a supporting pole 102 extending therefrom. The supporting pole 102 is encircled by a spring 20. Inlay board 30 has a connected tube

301 which is installed over spring 20 and supporting pole 102. Connected tube 301 includes an opening 3012. The spring 20 is enclosed within connected tube 301 on one end by inlay board 30 and on the other end by slide 40. A revolving casing 50 is placed over connected tube 301 and support cylinder and base 302 are situated parallel to inlay board 30. The two sides of the inlay board are preferably fastened with male 303 and female 3021 connectors. Female connectors 3021 have multiple flanges on their outer periphery for connection with a mutually engaging attaching orifice (shown in cutaway in FIG. 2).

There is a horizontal piece 401 extending from slide 40. Horizontal piece 401 is arranged to movingly engage opening 3012 and is biased away from inlay board 30 by spring 20. Now, refer to FIG. 3 and FIG. 4. Revolving casing 50 includes on its interior periphery, helical guide 502, locking portion 5022 having a protuberance 5021, stop 5023, and stop 5024. Helical guide 502 is sized to smoothly engage horizontal piece 401 of slide 40. In an inactivated state, spring 20 biases slide 40 at the top portion of revolving casing 50, causing horizontal piece 401 to engage both stop 5023 and helical guide 502. When turning the revolving casing 50, horizontal piece 401 moves along helical guide 502 until contacting protuberance 5021. Applying sufficient rotational force causes horizontal piece 401 to slide past protuberance 5021 and reside on locking portion 5022. Slide 40 remains in a position with its horizontal piece 401 on locking portion 5022 until it is placed back to the original status when sufficient counter-turning force is applied to the revolving casing 50, allowing it to be pushed off the locking portion 5022 and skipped over the protuberance 5021.

Figure 5:
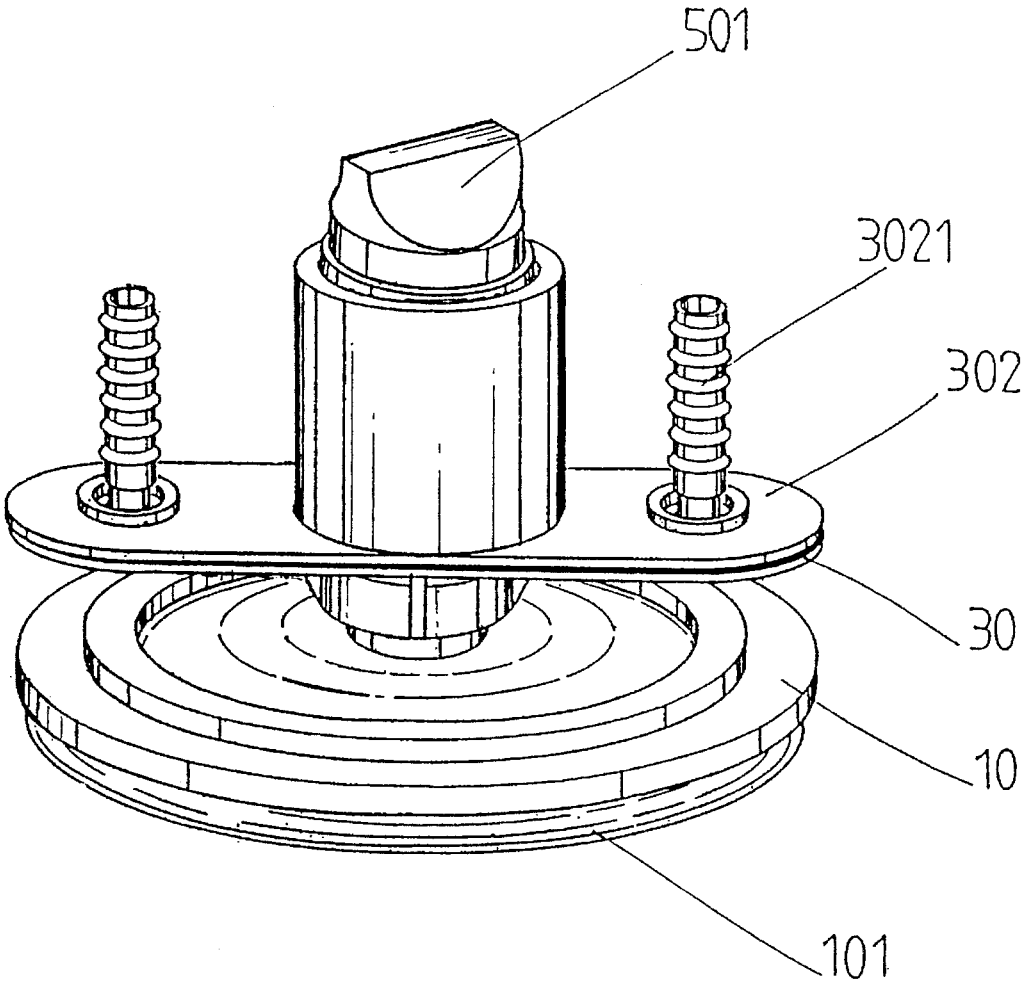
FIG. 5 is the view of this invention after being assembled.
Figure 6:
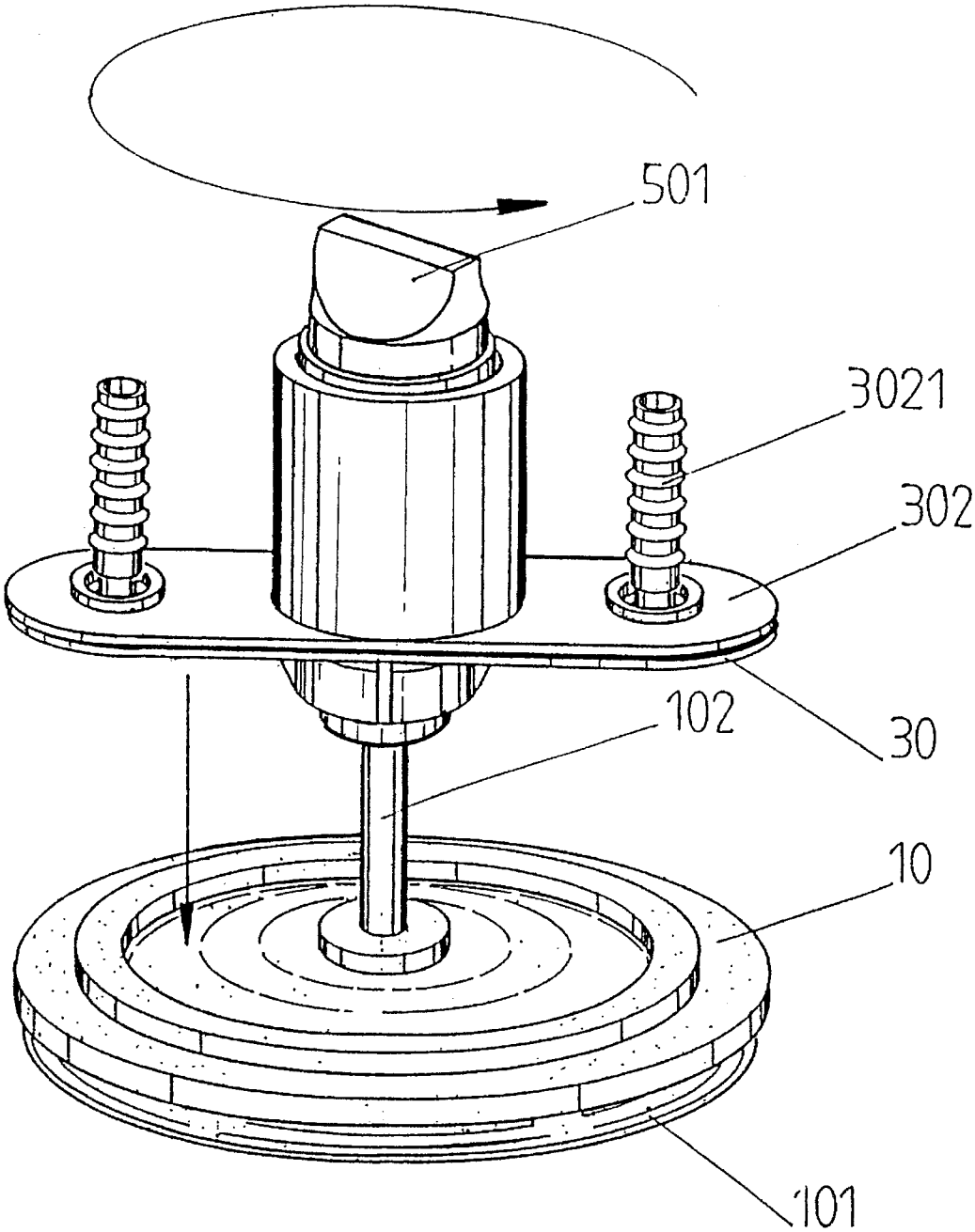
FIG. 6 is the operated example of this invention.
Figure 7:
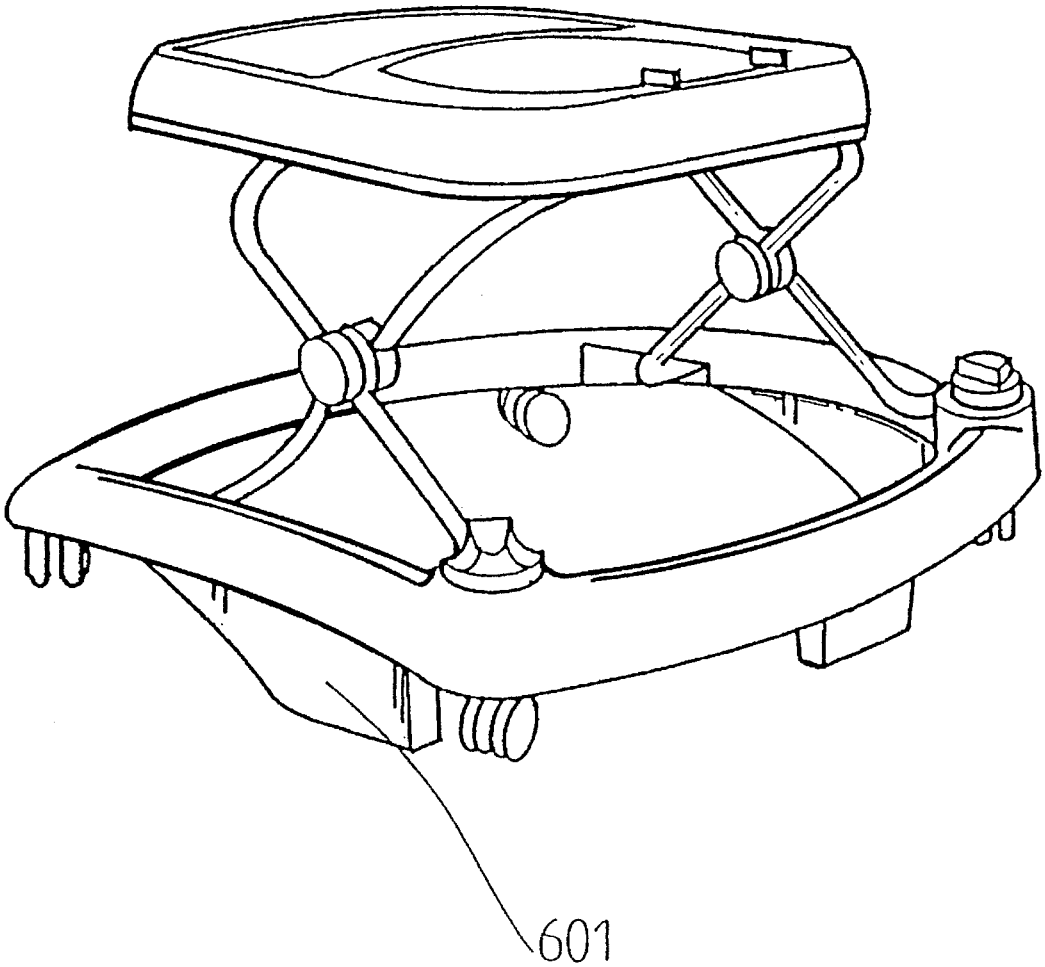
FIG. 7 PRIOR ART
FIG. 7 is the application of a traditional Baby's Walker.
Figure 8:
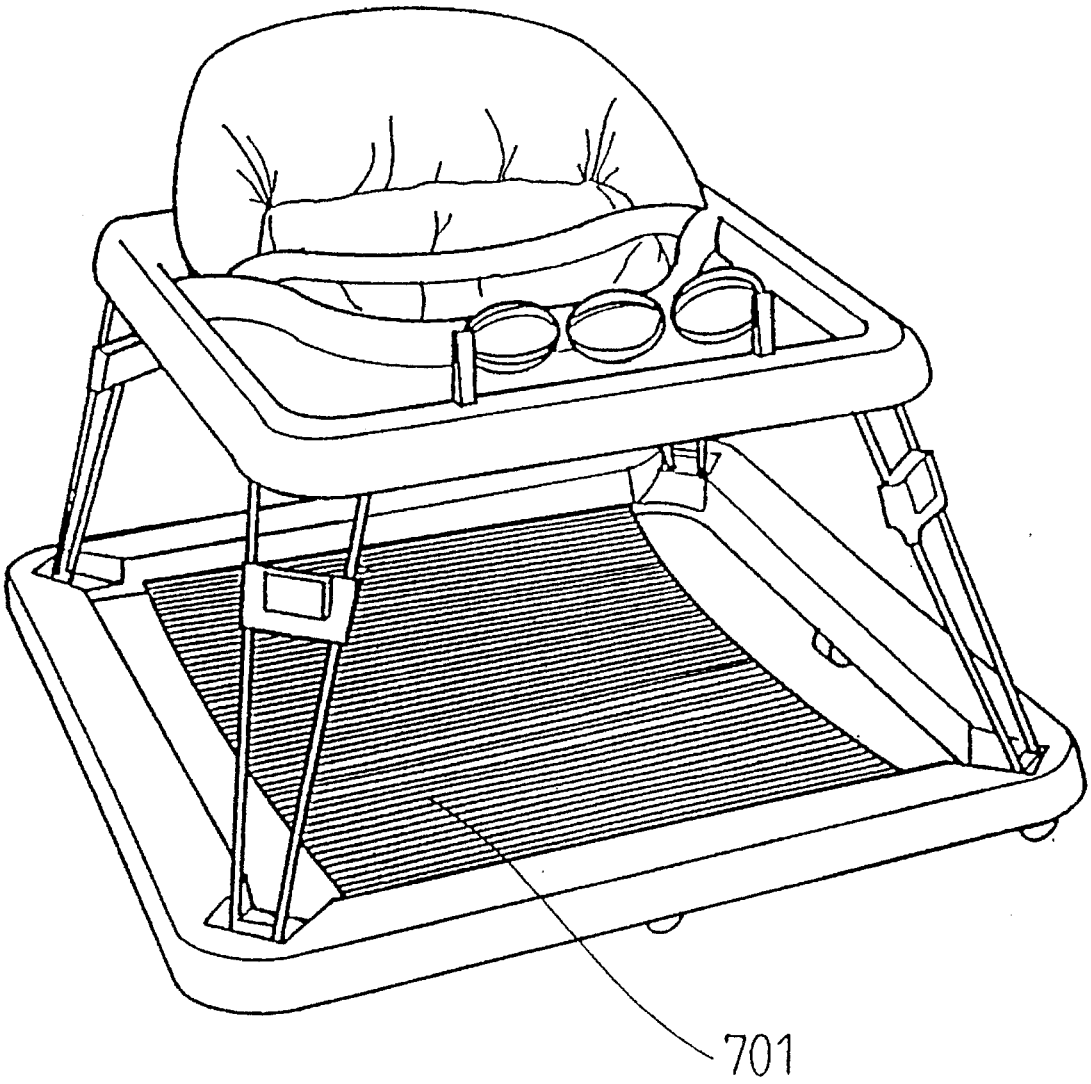
FIG. 8 PRIOR ART
FIG. 8 is the application of another traditional Baby's Walker.

Please refer also to FIG. 5 and FIG. 6. When the revolver switch 50 is not turned, the spring 20 inside is not compressed, the supporting pole 102 is substantially within inlay board 30 and the brake is in the folded status. When turning the revolving switch 501, slide 40 inside compresses spring 20 to the limit, pressing supporting pole 102 outwardly. The horizontal piece 401 moves along helical guide 502 inside revolving casing 50 as revolving switch 501 is turned, and goes over protuberance 5021 into locking portion 5022. Therein, horizontal piece 40 is limited by the protuberance 5021 and can not move freely up helical guide 502. After horizontal piece 401 resides on a locking portion 5021, the supporting pole 102 has been pushed out completely, the brake is pushed out and contacts the ground stably.

Figure 3:
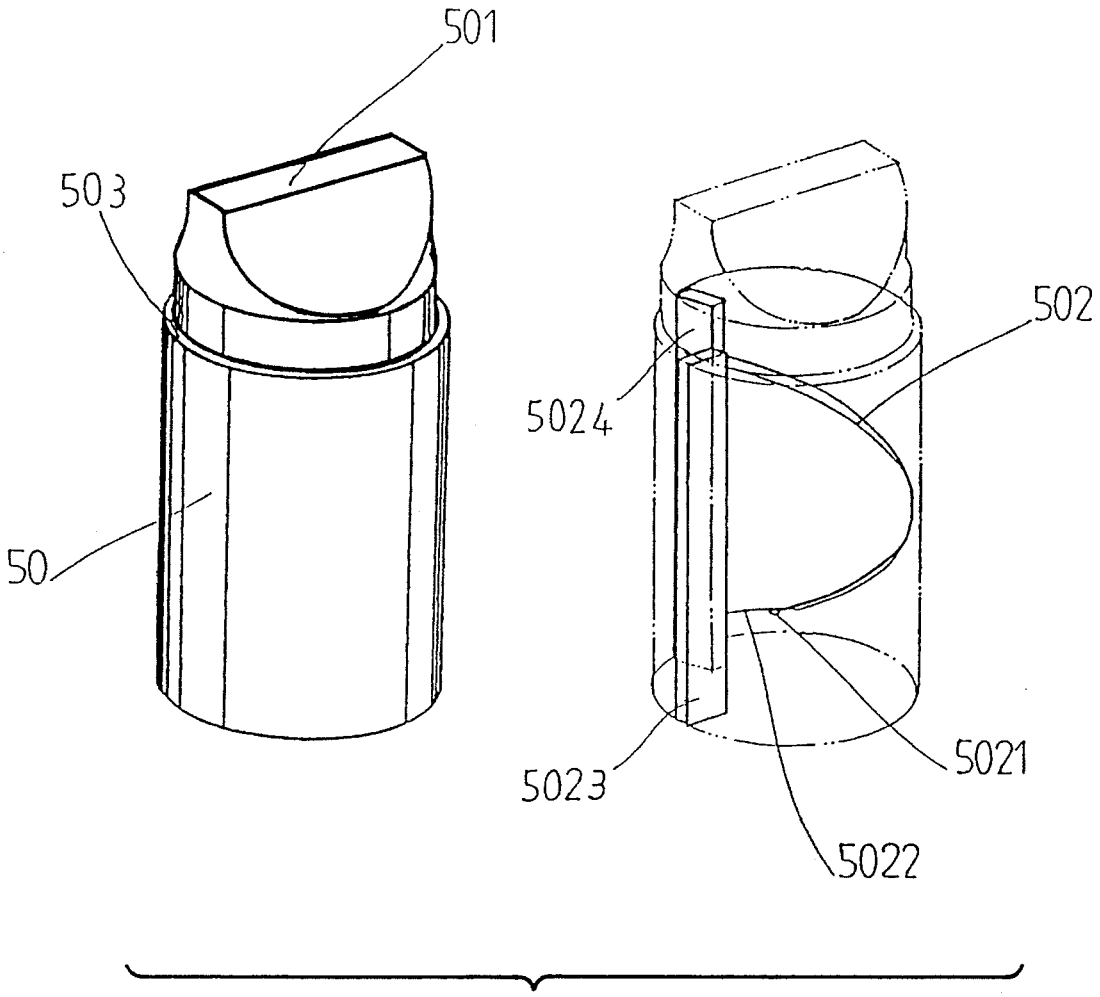
FIG. 3 is the inner structure of the revolving stand of this invention.
Figure 4:
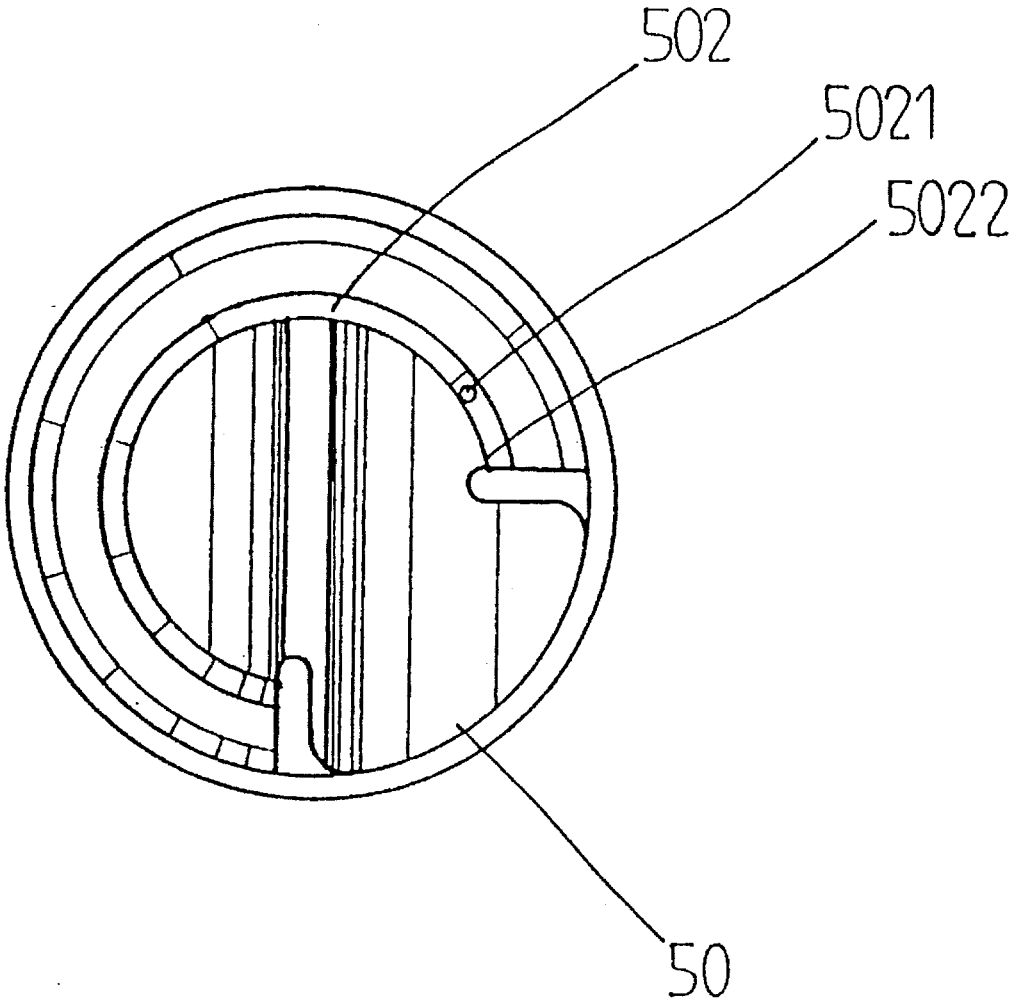
FIG. 4 is the view of the revolving stand of this invention from the bottom.
Figure 9:
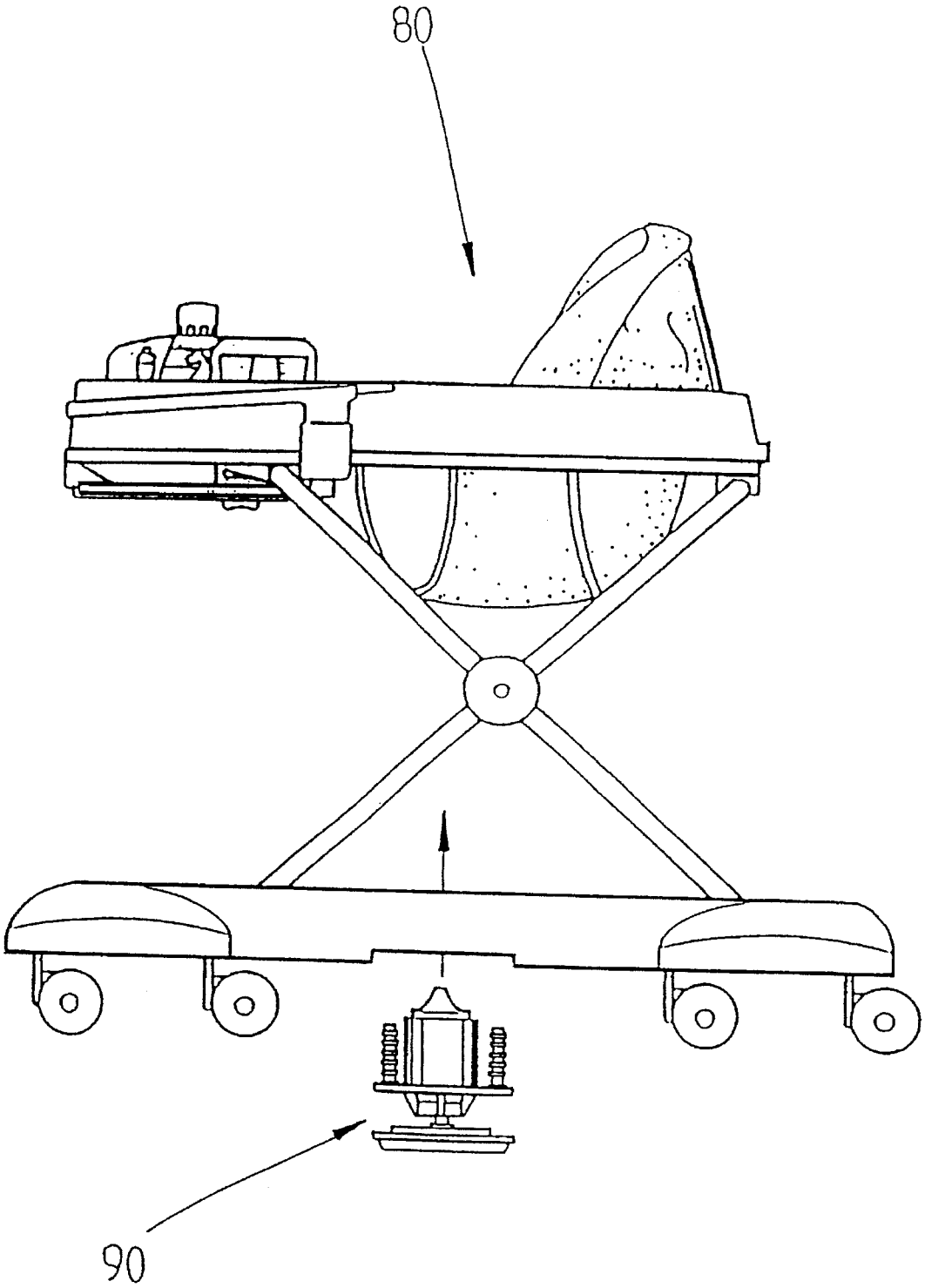
FIG. 9 is the view of composing of this invention.
Figure 10:
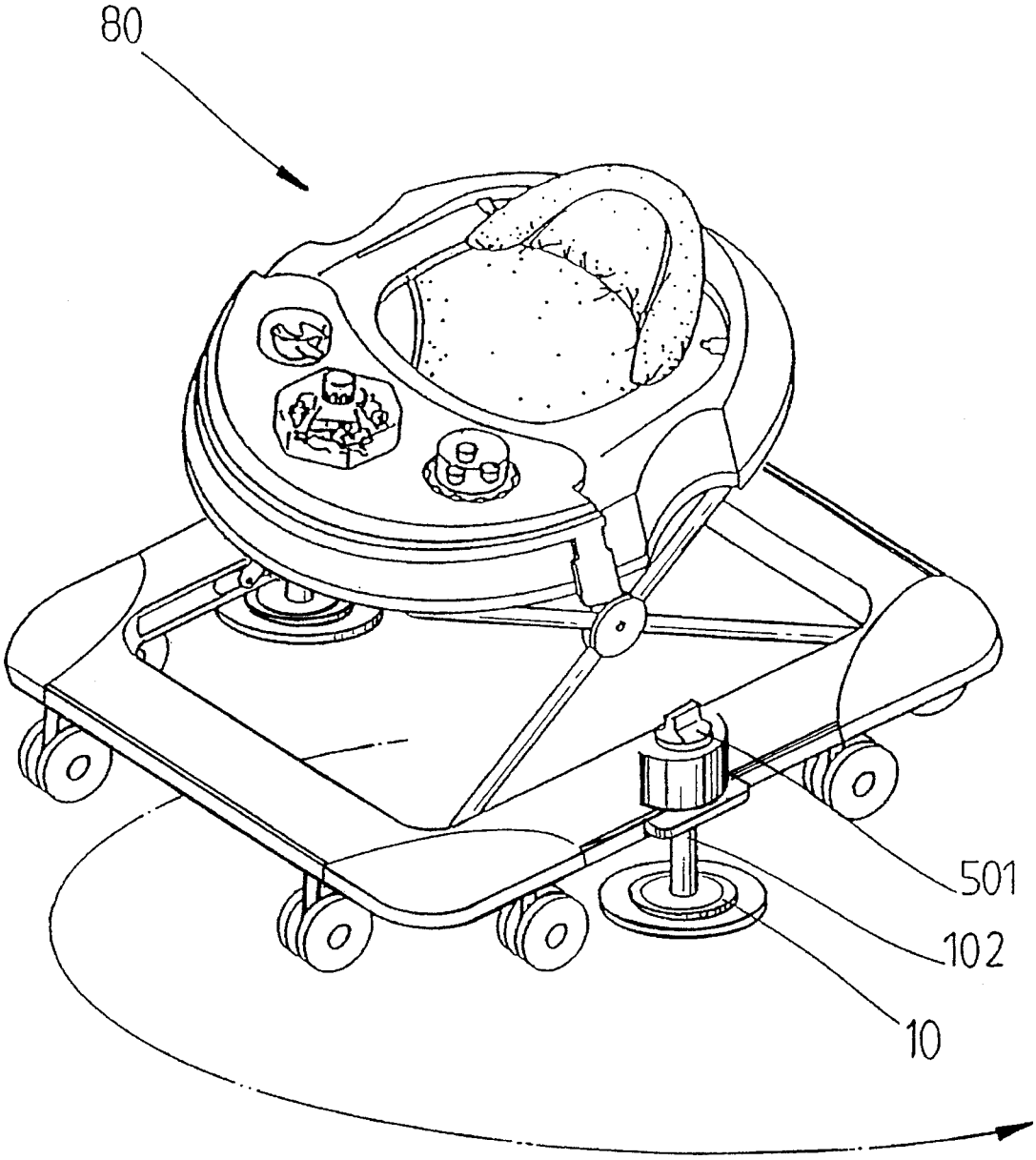
FIG. 10 is the operation of this invention.

FIG. 9 is an illustration showing the prepared implementation of this invention. The brake 90 is installed in the two sides of the baby's walker 80, preferably by engagement with female connectors 3021. An appropriately sized aperture in the walker restrains the revolving casing 50 by abutting annular step shoulder 503 (FIG. 3). Then refer to FIG. 10. Turning the revolving button 501 of the brake in one side makes the supporting pole 102 stretch out and the brake pad reach the ground. Thus, the walker can only revolve in a certain circle. Therefore, the kids can only slide in the fixed circle and will not be able to move from adults' sight. Even if adults are not nearby, there will not be any danger. At the same time, it can ensure safety when kids learn to walk and it is more fun for the kids to learn.

I claim:

1. A brake for a baby's walker, comprising:

an inlay board;

a connected tube having an opening and an inner periphery, said connected tube fixed on said inlay board;

a support cylinder having a base, said base being connectable to said inlay board;

a revolving casing having a helical guide, said revolving casing rotatably positioned between said connected tube and said support cylinder;

a slide having a horizontal piece, said slide movably engaging said inner periphery of said connected tube and said horizontal piece movably engaging said helical guide through said opening in said connected tube;

a spring disposed within said connected tube biasing said horizontal piece of said slide against said helical guide;

a brake pad; and a support pole having a first end and a second end, said first end rotatably engaging said brake pad and said second end fixedly engaging said slide, wherein rotation of said revolving casing causes said horizontal piece to move vertically within said opening in accordance with said helical guide, thereby vertically displacing said support pole and said brake pad.

2. A brake for a baby's walker as defined in claim 1, wherein:

said helical guide includes an upper stop and a lower stop, said upper stop being associated with a retracted position of said brake pad and said lower stop being associated with an extended position of said brake pad.

3. A brake for a baby's walker as defined in claim 2, wherein:

said helical guide further includes a protuberance and a locking portion, said locking portion being situated between said protuberance and said lower stop and is associated with said extended position of said brake pad, whereby said rotatable casing must be rotated with a sufficient amount of force to permit said horizontal piece to overcome said protuberance when either retracting said brake pad from said extended position or extending said brake pad into said extended position.

4. A brake for a baby's walker as defined in claim 3, wherein:

said brake pad includes a support and a slide resisting piece, said support being fixed to said slide resisting piece.

5. A brake for a baby's walker as defined in claim 4, wherein:

said inlay board and said base are connected with male and female interlocking fasteners.

6. A baby's walker, comprising:

a baby's walker having a base support; and a brake installed in said base support, wherein said brake includes an inlay board;

a connected tube having an opening and an inner periphery, said connected tube fixed on said inlay board;

a support cylinder having a base, said base being connectable to said inlay board;

at least one male and female interlocking fastener connecting said inlay board with said base, an outer periphery of said female interlocking fastener being encircled by a plurality of flanges, a revolving casing having a helical guide, said revolving casing rotatably positioned between said connected tube and said support cylinder;

a slide having a horizontal piece, said slide movably engaging said inner periphery of said connected tube and said horizontal piece movably engaging said helical guide through said opening in said connected tube;

a spring disposed within said connected tube biasing said horizontal piece of said slide against said helical guide;

a brake pad; and a support pole having a first end and a second end, said first end rotatably engaging said brake pad and said second end engaging said slide, wherein rotation of said revolving casing causes said horizontal piece to move vertically within said opening in accordance with said helical guide, thereby vertically displacing said support pole and said brake pad.

7. A brake for a baby's walker as defined in claim 6, wherein:

said base support of said baby's walker engages said plurality of flanges on said outer periphery of said female interlocking fastener.

* * * * *